US005117530A

United States Patent [19]

Rank

[11] Patent Number: 5,117,530

[45] Date of Patent: Jun. 2, 1992

[54] MATERIAL CLEARING DEVICE

[76] Inventor: Richard E. Rank, 2396 Governor Rd., Marshalltown, Iowa 50158

[21] Appl. No.: 576,772

[22] Filed: Sep. 4, 1990

[51] Int. Cl.[5] ..... A47L 1/06; E01H 5/02

[52] U.S. Cl. ..... 15/245; 37/285; 294/54.5

[58] Field of Search ..... 15/117, 118, 121, 146, 15/159 R, 160, 228, 245, 401, 171, 105; 56/400.09, 400.13, 400.14, 400.15; 294/54.5.57-59, 55; 37/265, 278, 284, 285

[56] References Cited

U.S. PATENT DOCUMENTS

| | | | |
|---|---|---|---|
| 509,876 | 12/1893 | Campbell . | |
| 543,910 | 8/1895 | Torr . | |
| 585,346 | 6/1897 | Stewart | 15/105 |
| 853,171 | 5/1907 | Healy et al. . | |
| 1,042,828 | 10/1912 | Selwa | 15/245 |
| 1,319,912 | 10/1919 | Starrett et al. . | |
| 1,497,933 | 6/1924 | Oberti | 15/245 |
| 1,678,135 | 7/1928 | Crosman et al. . | |
| 1,684,625 | 9/1928 | Hillyard | 15/245 |
| 1,720,630 | 7/1929 | Eiermann | 15/245 |
| 1,918,611 | 7/1933 | Oberti | 15/245 |
| 2,728,598 | 12/1955 | Szillage . | |
| 3,079,624 | 3/1963 | Neal | 15/245 |
| 3,119,138 | 1/1964 | Davis | 15/159 A |
| 3,134,129 | 5/1964 | Allen | 15/159 R |
| 4,094,543 | 6/1978 | Fratini | 294/54 |
| 4,597,204 | 7/1986 | Heiden | 37/285 |
| 4,602,401 | 7/1986 | Holroyd | 15/245 |
| 4,669,206 | 6/1987 | Yost | 37/285 |

FOREIGN PATENT DOCUMENTS

| | | | |
|---|---|---|---|
| 1109731 | 9/1955 | France | 294/58 |
| 450830 | 7/1936 | United Kingdom | 15/245 |

*Primary Examiner*—Philip R. Coe
*Assistant Examiner*—C. Cooley
*Attorney, Agent, or Firm*—Zarley, McKee, Thomte, Voorhees & Sease

[57] ABSTRACT

A device for clearing material is shown which includes a blade having an upper portion and lower portion, the lower portion being made of resilient material and the upper portion made of rigid material. The blade includes a middle area, and two sides. A handle angles upward and rearward from the blade. The two sides extend forwardly and outward from the middle, at an angle of less than 90° with respect to a vertically oriented plane intersecting the ends of the middle. A lip may extend forward at the top of the uppermost portion. Supports extend forward of the lip or top of the uppermost portion of the blade and are of a length sufficient to support the device in a stored position such that the forward surface is facing downward and the handle is in a nearly upright position.

12 Claims, 1 Drawing Sheet

MATERIAL CLEARING DEVICE

This invention relates to a device to be used for clearing any of a variety of material, such as snow, water, or other like movable material, and may even be used in lieu of a broom. It is particularly adapted for moving a large amount of material along a surface without lifting and to achieve the maximum pushing power with a relatively small amount of manual force applied.

Devices which are available for moving snow and the like include shovels and similar scoops which require that the device be pushed under the material to be moved, and then lifted for placing the material in a different area. Such devices have the considerable disadvantage of requiring the user to lift both device and material off the ground for removal. This can cause considerable strain upon the user, especially when snow or dirt is being removed. Further, it is an impractical means of removing water or other loosely scattered material.

Yet other devices overcome this problem by providing that the material may be moved by pushing the device along the ground. However, these devices also have several disadvantages. Typically, an elongated flat blade having a handle attached thereto has been used for clearing snow. While pushing the device along the ground to move the material is advantageous in not requiring any lifting, it nevertheless is somewhat inefficient as the material escapes around the sides of the flat surface. Still other devices attempt to overcome this problem by providing that the sides of the flat surface are bent forward so that they are perpendicular to the longitudinal axis of the rear most portion of the flat surface. This provides for a U-shaped or similarly shaped device. It may be used by pushing the rounded back surface forward so that it plows snow and other material out of the way. This is rather inefficient since such a device will have only a small surface area making contact with the material and moving it out of the way. Most of the material will be displaced to the side of the device. Alternatively, it may be pushed in the other direction, so that the U-shaped legs act as a scoop, and considerable effort will need to be employed in order to propel the device. The snow and other material compacts in the narrow area between the two legs, piling up, and making pushing difficult. Further, only a narrow area may be cleared at any one particular time.

Furthermore, each of these devices is difficult to store, requiring that it either be hung from a separately mounted hook or like device, or propped up against a wall. This can be dangerous, as the device may fall forward, or, when stepped on, the handle may spring forward and cause injury.

The present device overcomes these disadvantages by several of its unique features This includes an elongated blade which presents a wide front face for meeting the material to be moved. The sides are angled forward, but at an angle of less than 90°. This prohibits the material from escaping around the sides of the blade, while at the same time presenting a sufficiently wide front face that a large area of material may be moved at one time. Furthermore, the wide front face combined with the angled sides prevents the material from becoming so compacted in the device that it is difficult to push. To further aid in preventing material from escaping up and over the blade, the uppermost portion is formed into a lip which is curved or angled forward, and pushes the material back down in front of the blade.

The blade itself will consist of two parts, a lower portion which is made of resilient material to provide for flexibility as the device is moved over a variable surface. This allows the device to be moved without catching on rocks, cracks, or other obstacles along the surface. The uppermost portion is made of rigid material, and is preferably made of steel for strength. With the handle also located at the lowermost half of the steel upper portion, the amount of power needed to push the blade is further decreased. This is because the point of connection between handle and blade is more centered.

The device is further capable of compact, self-contained storage by providing for unique adaptations at either end of the uppermost portion of the blade.

Therefore, it is an object of this invention to provide for a device which clears material such as snow, water, and the like, without requiring lifting of the device and/or material.

A further object of the invention is to provide for a device which improves the forward movement of the materials.

Yet another object of the invention is to provide for a device which removes material from a wide area.

A still further object of the invention is to provide for maximum ease in clearing material.

Another object of the invention is to provide for a durable material clearing device.

A further object of the invention is to provide for a material clearing device which is capable of compact, self-contained storage.

Still further objects of the invention will become apparent through the following disclosure.

SUMMARY OF THE INVENTION

A manually operated material clearing device is provided which has a wide front face meeting the material, and is adapted for maximum frontal movement of material. It includes an elongated blade, having two sides and a middle, the sides are angled forward and outward from the middle such that the sides are not parallel. Preferably, the uppermost portion of the blade has a lip which is curved or angled forward to prevent escape of material over the top blade. The blade itself is comprised of a resilient lower portion, and a rigid upper portion. The handle of the device is located rearward of the blade and is preferably mounted at the lower half of the upper portion of the blade. The device is capable of compact self-contained storage by providing that supports extend forward of the uppermost portion of the blade either directly from the uppermost portion or from the lip and extend forward at a length sufficient to contact the ground at either end of the sides when the blade is face downward. In the most preferred embodiment, tips are provided extending forward of the blade, and preferably forward of the lip, which contact the surface such that when the blade is facing downward, the handle is in a nearly upright position.

DETAILED DESCRIPTION OF THE DRAWINGS

DETAILED DESCRIPTION OF THE PREFERRED EMBODIMENT

Figure 1:
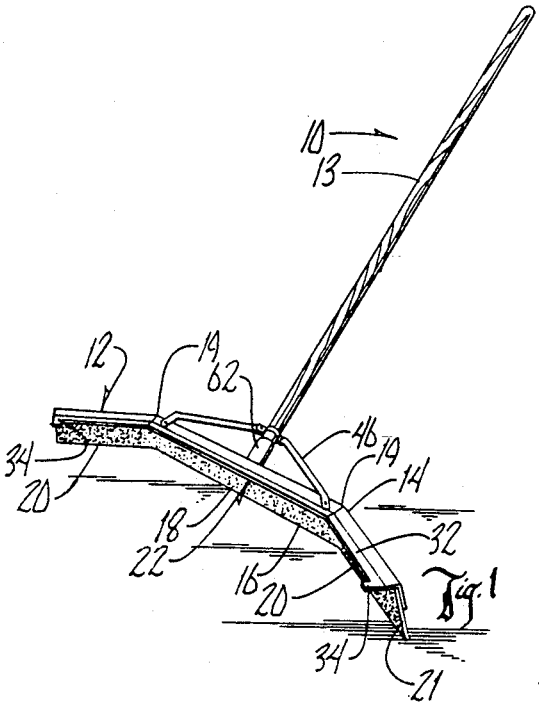
FIG. 1 is a perspective view of the material clearing device in a position ready for use.

The device of the invention is generally shown at 10, and is best seen in its in-use position in FIG. 1. The device 10 includes a blade 12 and handle 13. Blade 12 is comprised of an upper portion 14 and a lower portion 16. Preferably, the lower portion 16 is made of resilient material, such as rubber. This provides for ease in moving the device over an uneven surface. As the device encounters crevices or rocks, or the like, the resilient lower portion 16 may continue to be moved forward without jarring. In this preferred embodiment, the upper portion 14 is made of rigid material in order to provide strength and durability. An example of a suitable rigid material would include steel, and in this instance, it may include an angle iron. By providing that upper portion 14 is made of rigid material, this material will last longer and strength is provided to the device in moving the material forward. Upper portion 14 may be attached to lower portion 16 in any one of a variety of manners which would be clear to one skilled in the art. In this instance, upper portion 14 is shown being attached to lower portion 16 through rivets 17, best seen in FIG. 4.

The blade 12 includes three sections, a middle 18, and two sides 20. The blade has a forward surface 22 and a rearward surface 24. Forward surface 22 is that portion of blade 12 of the device which actually meets the material being moved. Sides 20 are angled forwardly and outward from the middle in order to prevent the material from escaping around the end of the blade 12. However, the inventor has found that if the sides 20 are angled too far forward, several disadvantages result.

One disadvantage is that there is less forward surface 22 meeting the material to be moved, and thus only a narrow area can be cleared at one time. By providing that the sides 20 are at less of an angle, a wider area may be cleared in one movement. Further, by angling sides 20 too far forward, and thereby decreasing the amount of forward surface 22 which meets the material, the amount of energy used to push the material forward must be increased because the material will pile up higher, impeding forward motion. If sides 20 are parallel to one another, then sides 20 are working exclusively to prevent the material from escaping around the sides, and provide more resistance to pushing. When a wider forward surface 22 is provided, the sides 20 act both to push material forward while discouraging escape of material around the sides. Less resistance and therefore less energy is required by the user to move the material. Thus, the inventor has discovered that when sides 20 are angled forwardly and outwardly from the middle 18 at an angle of less than 90° with respect to a vertically oriented plane intersecting ends 19 of middle 18 an improved device results. A wider front surface is available, which increases the area which is cleared in one pass, and which considerably decreases resistant force in moving material. The preferred embodiment illustrated shows the middle being straight and not curved, and so in this embodiment the angle may be described as less than 90° with respect to the lateral axis of the middle 18. The preferred angle of sides 20 is between 15° to 45°. The most preferred angle is 15°. At this particular angle, the maximum area may be cleared, with the minimum amount of pushing, while also prohibiting the material from escaping around the ends of the blade 12.

Considerable advantages are imparted by mounting the handle 13 at the rearward surface 24 of blade 12. While certain other devices have mounted the handle at the front, by mounting the handle of this device at the rearward surface 24, the forward pushing motion provided by the user is directed toward the strongest portion of blade 12, the midpoint. The handle may be placed at a variety of angles to suit the user. However, it has been found that the user will not need to bend forward, and will receive the maximum forward power for the energy expended where the handle is mounted so that it is at an approximately 45° angle with respect to a horizontal plane intersecting the point of attachment of the handle to the blade. In the embodiment shown where the middle 18 is not curved, this may be alternatively described as an angle of about 45°. with respect to the longitudinal axis of middle 18.

Upper portion 14 may also include a top 26 of the upper portion, a bottom 28 of the upper portion, and terminates in two ends 30. In the preferred embodiment of the invention, the top 26 of the upper portion extends forwardly to form a lip 32. It terminates longitudinally at opposite ends 33. This lip 32 discourages the material from escaping through moving up and over the blade 12. It will be evident to one skilled in the art that lip 32 may take any one of a number of different shapes. Lip 32 may be curved gradually forward, or it may extend at a sharp angle forward. In this particular embodiment of the invention, lip 32 is shown as being on a horizontal plane intersecting the top 26 of the upper portion. When lip 32 extends forward at this angle, it may be especially advantageous in conjunction with the system of storing the device in an upright position.

Figure 2:
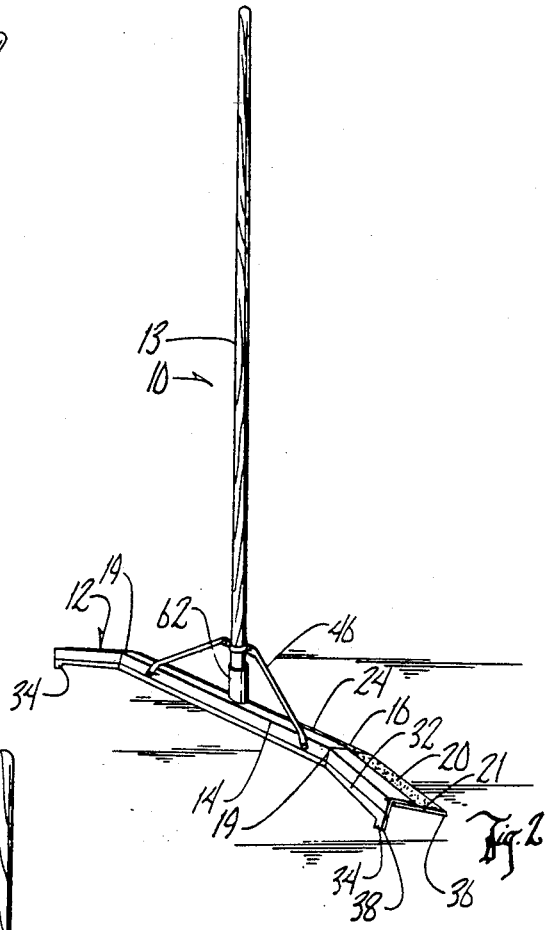
FIG. 2 is a perspective view of the device in accordance with the invention, in a stored position.
Figure 4:
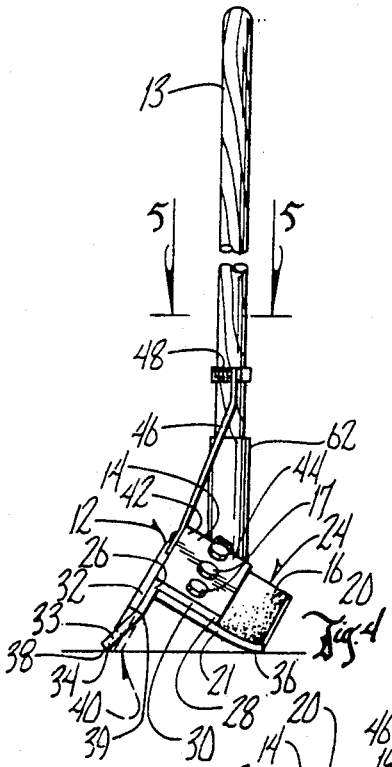
FIG. 4 is an enlarged partial side elevational view of the device of the invention in a stored position.
Figure 5:
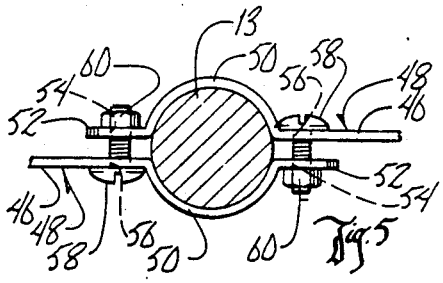
FIG. 5 is a sectional view taken along line 5—5 of FIG. 4 showing one method of attachment of the upper portion of the handle to the device.
Figure 3:
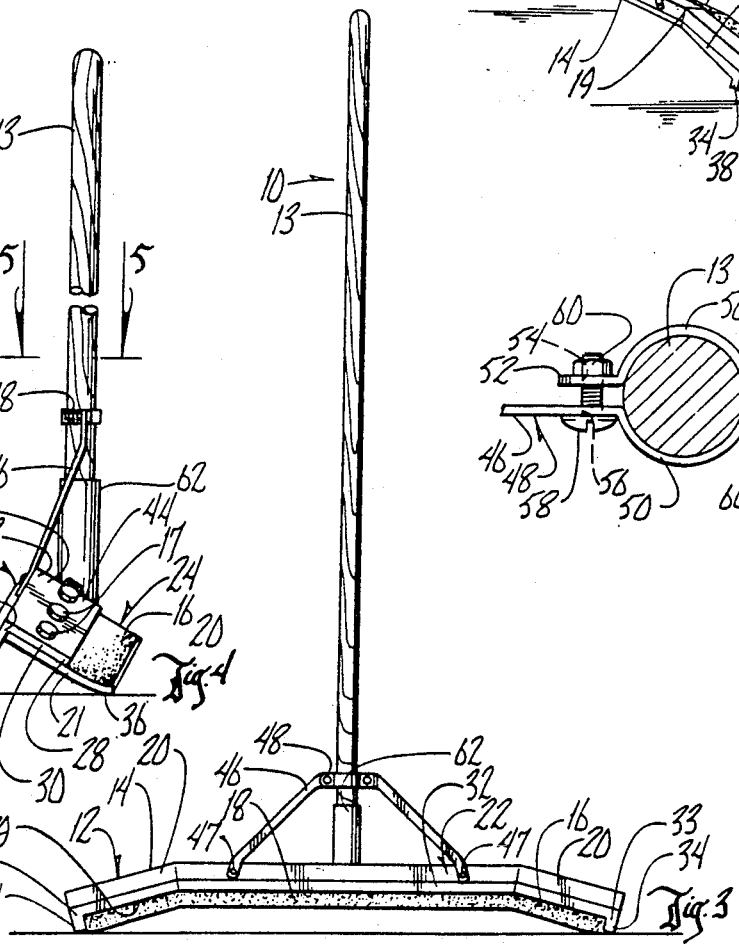
FIG. 3 is an elevation front view of the device of the invention in a stored position.

The device provides for a unique ability to be easily and conveniently stored so that the handle is in an upright position, the blade takes up the minimum amount of space possible and the device is stable. In the embodiment which is shown, supports 34 extend forward from either end 33 of lip 32. These supports 34 are shown as a pair of tab-like extensions in FIGS. 1 through 4. As is best seen in FIGS. 2–4, for storage, the blade 12 is positioned so that the forward surface 22 is generally facing downward. Lower portion 16 terminates at its end to provide a first support point 36 as seen in FIG. 4. Supports 34 terminate in second support points 38. Supports 34 are of a length sufficient so that when forward surface 22 is facing downward, each of support points 36 and 38 hold the device steady, and in a position so that handle 13 is nearly upright. Thus, as best seen in FIGS. 2 and 3, the device 10 takes up a small amount of space, with the handle in an upright position, and is stable against forward or backward movement. This eliminates the need to hang the device from a separate storing hook or mounting piece, and also eliminates the necessity of storing the device by leaning it against the wall. Instead, the device may be stored in any area desired while occupying only a small area.

There are several adaptations to this support mechanism which are possible. The supports can include tabs, legs, or even the lip itself. For example, if lip 32 is eliminated, supports 34 may extend directly forward from the top 26 of upper portion 14. If the shape of lip 32 is varied, the length of supports 34 will likewise need to be varied so that when forward surface 22 is pointed downward, handle 13 is nearly upright. As previously mentioned, when lip 32 extends forward on a horizontal plane intersecting the top 26 of upper portion, then supports 34 may extend directly forward in the same plane as lip 32. Alternatively, supports 34 may be eliminated altogether and instead either end 33 of lip 32 can extend forward at a sufficient length to provide contact with the surface in a similar manner to second support point 38.

In the preferred embodiment of the invention, supports 34, or the equivalent, are angled upward from the lip 32. This adaptation provides for even further stability of the device in its storage position. This angle of supports 34 is seen in FIG. 4. Without the upward angle, support 34 would contact the ground as shown in relation to the dotted line at 40. While the device would remain with the handle upright, when support 34 is angled upward from the lip, so that first support point 36 is further apart from second support point 38, additional stability is imparted to the device when in its storage position. In the preferred embodiment, the supports angle up from a horizontal plane intersecting the forward end 39 of lip 32 at an angle of about 15° to 45° . The most preferred angle is 45° .

It is evident that if the angle of the handle is varied from the preferred 45° angle with respect to the longitudinal axis of middle 18, that the length of supports 34 will need to be varied so that the device when stored has the handle in a nearly upright vertical position With the handle 13 in its preferred 45° angle, and with the supports extending forwardly at an approximate 90° angle with respect to the longitudinal axis of the middle, considerable stability is imparted to the device when in its stored position.

Upper portion 14 at its rearward surface 24 may be considered to have a top half 42 and a bottom half 44. The inventor has found that maximum forward motion when pushing is achieved by placing handle 13 so that it is attached at the bottom half 44 of the upper portion. This also increases stability when the device is in use.

Handle 13 may be mounted to blade 12 in any one of numerous ways. Just one example of a manner of attaching handle 13 to blade 12 is shown in the drawings. Braces 46 are attached to the top 26 of upper portion 14 by a screw and nut combination 47. The braces extend upward and rearward of blade 12 and connect to handle 13 via a flange 48. Flange 48 includes a semicircular portion 50 surrounding one half of handle 13. Each flange 48 ends in a terminal piece 52 and a hole 54 is provided in the terminal piece 52 in mating configuration with hole 56 in flange 48. The flanges 48 are then connected by screws 58 which extend through holes 54 and 56, and are secured in place by nut 60. Hollow rod 62 is welded to the lower half 44 of upper portion 14 and surrounds the end of handle 13 to impart further stability to the handle 13. Those skilled in the art will know that there are numerous variations for attachment of handle 13 to blade 12.

One skilled in the art will recognize that a number of adaptations are available which still keep in spirit with the contributions of the invention. In one example of this device, the middle portion 18 is approximately 22 inches in length and sides 20 are about 4 inches in length and extend 15° forward with respect to the lateral axis of the middle 18. Lip 32 extends forward at a perpendicular angle with respect to the longitudinal axis of the middle 18. The height of the blade 12 is about 4 inches. Lip 32 extends forward approximately 1.5 inches, and the supports extend forward about 0.5 inches. Handle 13 extends rearwardly at a 45° angle with respect to the longitudinal axis of the middle and is about 6 feet long.

This is merely one example of an embodiment of the invention. Clearly, numerous adaptations in size and angles are possible. Smaller sizes are particularly useful when the device is used as a substitute for a broom.

Thus, it can be seen that the invention accomplishes at least all of its objectives.

I claim:

1. A manually operated material clearing device comprising:

an elongated blade comprising a resilient lower portion and a rigid upper portion, the blade having a forward surface, a rearward surface, a middle having two end portions, and two sides, each extending from either end portion of the middle;

the sides extending forwardly and outwardly from the middle at and angle of less than 90° with respect to a vertically oriented plane intersecting the ends of the middle;

a handle attached to the blade and extending rearwardly from the blade; and the upper portion of the blade having a top, a bottom and two ends with a pair of supports, each support located adjacent the ends of the top of the upper portion, the supports extending forwardly and having a length sufficient to support the device on a horizontal surface when the forward surface is facing downward and the handle is in a free-standing upright position for storage of the device.

2. The device of claim 1 wherein the upper portion has a lip extending forwardly from the top.

3. The device of claim 2 wherein the lip has a forward end which extends forwardly from the top at an angle of up to about 90° with respect to a vertical plane intersecting the top of the upper portion.

4. The device of claim 2 wherein the supports extend from the lip.

5. The device of claim 4 wherein the lip has a forward end, the supports extend forward and upward from the lip at an angle of 15° to 45° with respect to a horizontally oriented plane intersecting the forward end of the lip.

6. The device of claim 5 wherein the supports extend upward at a 45° angle with respect to a horizontally oriented plane intersecting the forward end of the lip.

7. The device of claim 5 wherein the angle of the supports is 35° to 45° with respect to a horizontally oriented plane intersecting the forward end of the lip.

8. The device of claim 1 wherein the sides are at an angle of 15° to 45° with respect to the vertically oriented plane intersecting the ends of the middle.

9. The device of claim 1 wherein the sides are at an angle of 15° with respect to the vertically oriented plane intersecting the ends of the middle.

10. The device of claim 1 wherein the handle attaches at a point on the rearward surface of the blade and the handle extends upward at an angle with respect to a horizontal plane intersecting the point of attachment of the handle to the blade.

11. The device of claim 1 wherein the handle is at an angle of 45° with respect to a horizontal plane intersecting the point of attachment of the handle to the blade.

12. The device of claim 1 wherein the upper portion has a top half and bottom half, the handle being attached at the bottom half of the upper portion of the blade at the rearward surface of the blade.

* * * * *